United States Patent [19]

Nicolas et al.

[11] Patent Number: 5,069,869

[45] Date of Patent: Dec. 3, 1991

[54] PROCESS FOR DIRECT SHAPING AND OPTIMIZATION OF THE MECHANICAL CHARACTERISTICS OF PENETRATING PROJECTILES OF HIGH-DENSITY TUNGSTEN ALLOY

[75] Inventors: Jean-Claude Nicolas, Lyon; Raymond Saulnier, Bonneville, both of France

[73] Assignee: Cime Bocuze, Courbevoie, France

[21] Appl. No.: 697,500

[22] Filed: May 3, 1991

Related U.S. Application Data

[63] Continuation of Ser. No. 626,232, Dec. 11, 1990, abandoned, which is a continuation of Ser. No. 370,188, Jun. 22, 1989, abandoned.

[30] Foreign Application Priority Data

Jun. 22, 1988 [FR] France ..... 88 08888

[51] Int. Cl.[5] ..... B22F 3/24

[52] U.S. Cl. ..... 419/28; 419/25; 419/29; 102/517; 102/518; 102/519; 29/1.22

[58] Field of Search ..... 419/25, 28, 29; 75/224, 75/126; 102/517, 518, 519

[56] References Cited

U.S. PATENT DOCUMENTS

| | | | |
|---|---|---|---|
| 3,890,145 | 6/1975 | Hivert et al. | 75/224 |
| 3,979,234 | 9/1976 | Northcutt, Jr. et al. | 148/126 |
| 4,665,828 | 5/1987 | Auer | 102/519 |

*Primary Examiner*—Brooks H. Hunt
*Assistant Examiner*—Leon Nigohosian, Jr.
*Attorney, Agent, or Firm*—Oblon, Spivak, McClelland, Maier & Neustadt

[57] ABSTRACT

A process for shaping penetrating projectiles useful in the manufacture of military ammunition, comprising: preparing an alloy of tungsten, nickel, iron and copper by powder metallurgy, compacting the alloy mass into a rough shaped blank having an axis of revolution, sintering the rough shaped blanks thereby producing a blank having a density of at least 17,000 kg/m$^3$, and work-hardening the sintered blank at a temperature ranging from ambient temperature to 500° C., thereby producing a blank having a variable degree of reduction in section in a direction parallel to the axis of the blank.

6 Claims, 3 Drawing Sheets

PROCESS FOR DIRECT SHAPING AND OPTIMIZATION OF THE MECHANICAL CHARACTERISTICS OF PENETRATING PROJECTILES OF HIGH-DENSITY TUNGSTEN ALLOY

This application is a continuation of application Ser. No. 07/626,232, filed on Dec. 11, 1990, now abandoned, which is a continuation of Ser. No. 07/370,188 filed June 22, 1989, now abandoned.

BACKGROUND OF THE INVENTION

1. Field of the Invention

This invention relates to a process for direct shaping and optimization of the mechanical characteristics of penetrating projectiles of high-density tungsten alloys, in particular projectiles for military ammunition.

2. Description of the Background

Penetrating projectiles which are used in military weapons have undergone considerable development in recent years. The use of alloys of increasing density, with the objective of optimizing the mechanical characteristics thereof, in combination with an increase in the rate of fire, has made it possible to produce increasingly effective projectiles.

Alloys which thus far have been developed included:

Alloys based on depleted uranium, with which it is possible to achieve a density of close to 19,000 kg/m$^2$ and good ductility. The use of such alloys is made attractive by the need to find outlets for the stocks of depleted uranium which are generated by the nuclear industry;

Tungsten carbide containing about 13% to 15% of cobalt. This alloy, however, suffers from the disadvantage of having a density of 14,000 kg/cm$^3$, which is insufficient for certain uses. Moreover its low level of ductility can be a handicap from the point of view of piercing multiple targets;

Tungsten-based alloys which are produced by powder metallurgy. The tungsten used in the preparation of such alloys contains the usual impurities, the alloy exhibits low ductility and the machining of the alloy is delicate, both of which factors are impediments to its use. Other alloys of tungsten with, for example, nickel, copper and iron, resulting in alloys of the W-Ni-Cu and W-Ni-Fe type, are such that the properties of the alloys can be relatively well controlled depending upon the use of the alloy. For example, in the case of W-Ni-Cu alloys which have a density of between approximately 17,500 and 18,500 kg/m$^3$, the same have a mean ductility which is an attractive feature from the point of view of the fragmentation of the projectile. In the case of W-Ni-Fe alloys, whose density can also be adjusted to between 17,500 and 18,500 kg/m$^3$ by varying the tungsten content (93% to 97% by weight), the ductility of these alloys can be modified as a function of the Fe/Ni ratio.

The production of W-Ni-Cu and W-Ni-Fe alloys which are also referred to as "heavy metals" is accomplished by powder metallurgy. The raw materials are used as powders of each of the metals having a granulometry of between about 2 and 10 $\mu$m. The powders are mixed in rotary apparatuses, in particular, thereby producing a homogeneous product, the analysis of which corresponds to the desired composition. The mixture is then formed into the form of blanks of a profile which is suitable for the required use, either by a compression operation in a steel shaping die or by isostatic compression, in the course of which the powder which is placed in a rubber mold is subjected to the action of a compression fluid in an enclosure at high pressure. The blanks produced are porous, of low density and fragile and they have to be subjected to a densification operation which is effected by sintering at a temperature approximately between 1400° and 1600° C. in furnaces in a hydrogen atmosphere. In the course of densification a ternary phase formed by the three metals involved is formed by diffusion and becomes liquid. That liquid encases the grains of tungsten and permits complete densification of the alloy by a substantial dimensional contraction of the blank.

The alloys based on tungsten metal, the process for the production of which has just been described above, may exhibit ductility. By virtue of this property, it is possible to improve their elastic limit and their breaking stress, by a working operation.

Thus, for example, a blank made from an alloy containing by weight 93% W, 4.5% Ni and 2.5% Fe, after sintering at 1450° C., has the following characteristics:
density: 17,500 kg/m$^3$
resistance to 0.2% elongation Rp 0.2: 750 MPa
breaking strength Rm: 950 MPa
elongation: 25%.

After homogeneous working of the blank at a rate of reduction in section of about 18%, the blank has the following strength values:
Rp 0.2: 1100 MPa
Rm : 1250 MPa.

A work-hardened material of this kind is used to produce subcaliber projectiles intended for piercing armour plating as it has a high elastic limit capable of withstanding the stresses due to acceleration in the gun in which the muzzle velocities can attain 1400 to 1600 m/sec. When the blank is to be worked to produce such projectiles, the blank is generally a cylindrical shape and the working operation is hammering in a moving mode. In order to impart the definitive profile of the projectile to the blank, it is then subjected to a suitable machining operation.

A process of that kind is described in U.S. Pat. No. 3,979,234. It is stated therein that projectiles of W-Ni-Fe alloy of the composition by weight of 85–90% W, with the Ni/Fe ratio ranging from 5.5 and 8.2, are produced by powder compression, sintering, working the blank at a rate of reduction of 20% and then final machining of the worked blank. By this process it is possible to achieve a Rockwell hardness of 42, which is uniform to within plus or minus one unit.

It should be noted however that such a process suffers from two major disadvantages:

On the one hand, the operations of machining the blank after sintering and after working result in a relatively substantial loss of expensive material, which has a serious adverse effect on the cost price of the projectiles, not to mention the labor costs that it involves:

On the other hand, homogeneity of the properties of the projectiles is not always desirable. In fact, projectiles are subjected to different forces acting thereon during their use which include:

(i) mechanical shock stresses when the projectiles are loaded at a high rate into the barrel of the gun;
(ii) very high elastic stresses during the phase of acceleration in the gun; and
(iii) various stresses upon impact against the target which may be composed of layers of different materials, causing the phenomena of compression, working and increase in temperatures.

Moreover, it is desirable that, in the final phase of penetration of a target, the projectiles fragment in order to increase their destructive capacity.

For all those reasons, it is desirable to provide projectiles which are constituted of zones with different metallurgical characteristics which are optimized in such a way as best to comply with the specific forces to which they will be locally subjected. A need therefore continues to exist for a process of forming penetrating projectiles which remedies the two disadvantage referred to above.

SUMMARY OF THE INVENTION

Accordingly, one subject of the present invention to provide projectiles for military ammunition which have zones of different metallurgical characteristics, which are produced by a more simple process and which provide for the elimination of waste of expensive alloy material.

Briefly, this object and other objects of the present invention as hereinafter will become more readily apparent can be attained in a process of producing projectiles for military ammunition by preparing an alloy of tungsten, nickel, iron and copper by powder metallurgy, compacting the alloy mass into a rough shaped blank having an axis of revolution, sintering the rough shaped blank thereby producing a blank having a density of at least 17,000 kg/cm$^3$, and work hardening the sintered blank at a temperature ranging from ambient temperature to 500° C., thereby producing a blank having a variable degree of reduction in section in a direction parallel to the axis of the blank.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
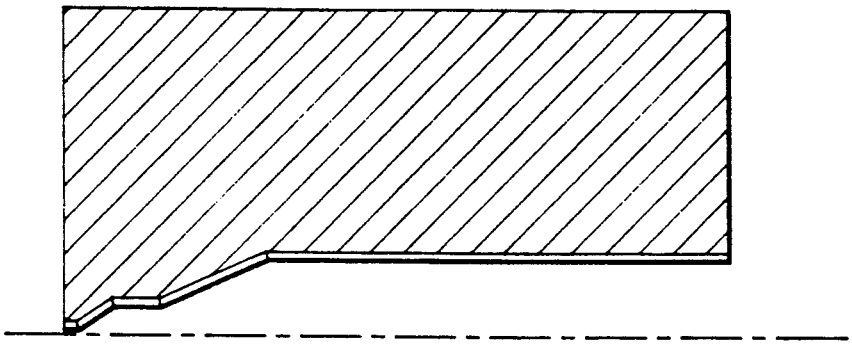
FIGS. 1 to 3 show the hammering profile and shaped blank profiles obtained by hammering of a rough shaped blank produced in Example 1.

The tungsten alloy employed in the present invention is an alloy selected from the likes of W-Ni-Cu and W-Ni-Fe. A blank is formed having an axis of revolution which in most instances is cylindrical or cylindrical-conical.

The alloy blanks have a density which is at least 17,000 kg/cm$^3$ and are produced by powder metallurgy from powders of tungsten, nickel, iron and copper which have been mixed, compacted in the form of blanks and sintered in a hydrogen atmosphere a temperature between 1400° and 1600° C., which are processing conditions which, when combined with the nature of the alloy, make it possible to provide ductile products which do not run the risk of being degraded in the work-hardening operation.

An important aspect of the present invention however is the fact that the rough blanks produced, that is to say the blanks which are produced after sintering without any preliminary machining operation which imparts a definitive profile of the projectile to the blank, are subjected to a work-hardening treatment.

That treatment is carried out on blanks which are either cold or which have been subjected to moderate preliminary heating which does not exceed 500° C. The heating operation depends on the nature of the alloy and makes it possible to reduce the force to be applied to achieve the desired degree of work-hardening.

Under those conditions the material which constitutes the alloy blank is relatively ductile and lends itself well to deformation into the definitive profile of a projectile without having recourse initially to a machining operation while at the same time imparting thereto a much higher level of mechanical strength.

However, unlike prior art processes, in the different sections of the blank which are perpendicular to its axis of revolution, the work-hardening operation is controlled so as to produce a projectile, which throughout its length, exhibits mechanical characteristics which are adapted, that is to say optimized to the heterogeneous stresses to which the projectile is subjected during its use. Thus, the degree of reduction from the initial section S to the final section s of the blank as defined by the ratio S-s)/S$\times$100 may vary from 5% to 60%.

An aspect of the present invention is that in order for the rough-produced blank of suitable shape to be directly subjected to a work-hardening treatment in order to produce the definitive profile of a projectile, the process of the invention is applied in the same way to a blank of suitable shape which is produced by machining a rough-produced blank, generally of simple geometrical shape such as a cylinder, a parallelpiped, or the like in accordance with the prior art. Accordingly, an attractive economic feature of the present process is that the operation of machining the sintered blank before working the same is eliminated. However, the elimination of this operation does not detrimentally affect the present process in any way.

Besides the fact that the elimination of machining after work-hardening has the desirable feature of eliminating labor equipment maintenance costs and wastage of relatively expensive material, the eliminated machining step makes it possible to keep surface layers in a compressed state at the surface of the projectile, which greatly enhances this resistance of the projectile to the different elastic forces to which it is subjected.

The work-hardening operation is performed by means of any suitable process, preferably with rotary hammering of the blank so as to develop mechanical characteristics of an axially symmetrical nature. The hammering operation can be carried out by means of different apparatuses such as for example a rotary or alternating hammering machine provided with a shaping tool arrangement comprising at least two hammers. Thus it is possible, for example, to use a tool arrangement having four hammers, the profile of which is defined by the shape of the desired projectile. The striking rate of the hammers is about 2000 to 2500 blows per minute.

The hammers are made of high-speed steel, in order to achieve higher levels of production. Hammers made from tungsten carbide are preferred. These hammers more effectively deal with the problems of wear and the dimensional tolerances to be achieved on the projectile. In order to limit the force to be exerted by the machine, the blanks are preheated before hammering to a temperature of between 250° C. and 500° C. depending on the materials involved and the degrees of work-hardening employed. The blank is introduced into the tool arrangement by a push mechanism which permits it to be held between centres and which, by means of a jack, provides for translatory movement of the projectile along the axis of the tool arrangement at a variable speed compatible with the hammering stresses involved.

The travel of the hammers may be precisely controlled in order to provide for the desired degrees of work-hardening and the dimensional tolerances required on the different parts of the projectile. The dimensions in regard to diameter can be easily controlled to give a tolerance of ±0.05 mm.

In order to appreciate the variations in mechanical characteristics which can be obtained depending on the degree of work-hardening, Table I below sets forth results which were obtained on testpieces measuring 15 mm in diameter, corresponding to three types of tungsten alloys. The results obtained are based on a Vickers hardness of HV30 depending on measurement taken at points on the axis of the bar.

TABLE I

| | Alloy W—Ni—Fe (93% /W) Degree of working | | | Alloy W—Ni—Fe (95% W) Degree of working | | | Alloy W—Ni—Fe (97% W) Degree of working | | |
|---|---|---|---|---|---|---|---|---|---|
| Distance from the axis in mm | 6% HV30 | 10% HV30 | 15% HV30 | 6% HV30 | 10% HV30 | 15% HV30 | 6% HV30 | 10% HV30 | 15% HV30 |
| 0 | 400 | 435 | 476 | 422 | 457 | 487 | 436 | 476 | 527 |
| 2 | 412 | 442 | 481 | 429 | 464 | 492 | 441 | 482 | 532 |
| 5 | 422 | 454 | 486 | 438 | 471 | 498 | 467 | 494 | 538 |
| 7 | 438 | 476 | 499 | 459 | 484 | 519 | 489 | 508 | 550 |

From the data obtained it can be observed that:

(i) The variation in hardness is a direct function of the concentration of tungsten in the alloy, on the one hand, and the degree of work-hardening produced, on the other hand.

(ii) Within the material, the hardness increases from the centre of the testpiece to the outside surface layers.

(iii) That variation from the center towards the edge is not linear, but changes at increasing rate at the periphery, the rate of increase increasing the proportion to an increasing level of working.

For the three types of alloys in question, it is noted that:

(a) For a degree of working of 6%, the mean difference in HV30 from 0 to 5 mm is greater than that from 5 to 7 mm, whereas there is equivalency for a degree of working of 10%.

(ii) For a degree of working of 15%, the mean difference in HV30 from 0 to 5 mm is less than that from 5 to 7 mm. These data confirm the attraction of not removing or damaging by machining the surface layers of the material which are produced after work-hardening.

FIGS. 1 to 9 show axial sections of alloy blanks before and after hammering, on which are indicated the hardness values as measured at different points as well as the profile of the tooling arrangement used for the hammering operation.

EXAMPLE 1

Alloy of tungsten-nickel-iron with 93% tungsten

A mixture of powders of the following contents by weight is produced:

93% of pure tungsten
4.5% of pure nickel
2.5% of pure iron.

Figure 2:
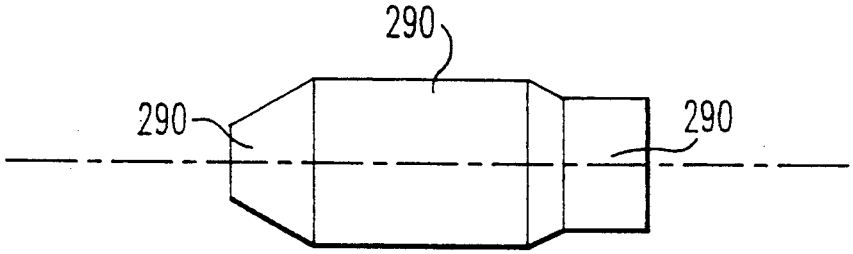

Blanks are produced by isostatic compression at 2000 bars of given mixtures of powders in molds of a shape which is homothetic with that shown in FIG. 2. The blanks are then placed on plates of alumina and sintered in a tunnel furnace in a hydrogen atmosphere at 1460° C.

After treatment of the blanks under vacuum at 1100° C. testpieces having the following characteristics were prepared:

Rp0.2 = 750 MPa approximately
Rm = 950 MPa approximately
E % = 25% approximately
density = 17600 kg/m$^3$ approximately.

The shaping operation is then carried out in a hammering machine having four hammers, the profile of which is shown in FIG. 1.

In this Example, the objective is to achieve a high level of hardness at the front of the projectile (tip), good ductility in the central part of the projectile and a capacity for fragmentation in the rear part of the projectile.

The striking hammers of the hammering apparatus were made of high-speed steel. The blanks were preheated to about 350° C. prior to hammering. To limit the work-hardening stresses, the operation was carried out in two successive passes between the hammers. The tool arrangements were set in the first pass to a degree of reduction of approximately 25% at the sections which were most highly work-hardened. After the second pass, a heat treatment was effected in argon at about 550° C.

Figure 3:
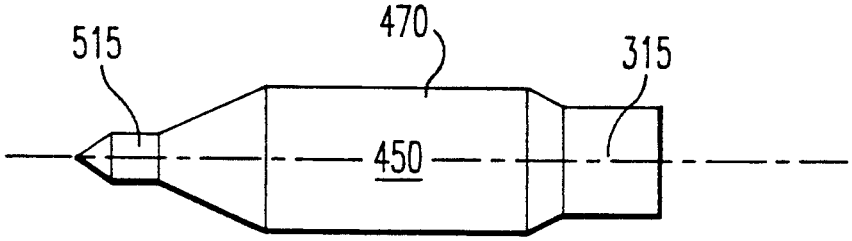

The variation in the shapes of the projectile and hardness HV30 before and after hammering is shown in FIGS. 2 and 3.

EXAMPLE 2

Alloy of tungsten-nickel-iron with 95% of W

A mixture of powders containing the following components by weight is produced:

95% of pure tungsten
3.2% pure nickel
1.8% of pure iron.

Figure 4:
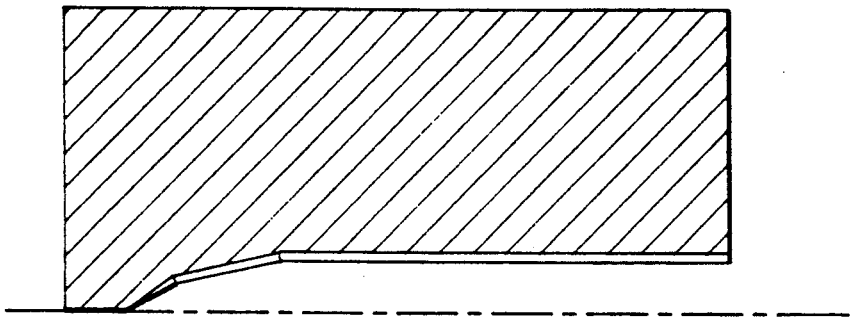
FIGS. 4 to 6 show the hammering profile and shaped blank profiles obtained by hammering of a rough shaped blank produced in Example 2.

The blanks are compressed in an isostatic chamber at 2000 bars in rubber molds of a form which is homothetic with the shape of the blank shown in FIG. 4. The blanks are then sintered in a tunnel furnace in hydrogen at 1510° C. After treatment of the blanks under vacuum at 1100° C. the following characteristics are obtained on testpieces:

Rp 0.2=720 MPa approximately
Rm=940 MPa approximately
E %=25% approximately
density=18000 kg/m$^3$ approximately.

The hammering operation is then effected, using the machine referred to in Example 1. The profile of the hammers, which is adapted to this type of projectile, is shown in FIG. 4.

In this Example, the objective was to achieve a high level of hardness in the tip of the projectile, a high level of elasticity in its central portion and a high level of ductility at the rear. The striking hammers were made of high-speed steel and the blanks were preheated to about 400° C. before hammering. The hammering operation was carried out in a single pass.

A heat treatment was then effected, in argon, at about 860° C.

Figure 5:
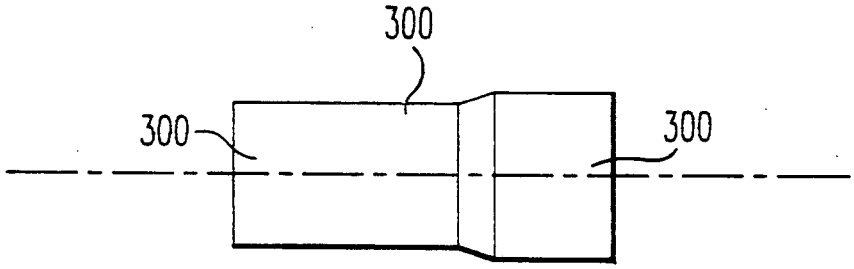
Figure 6:
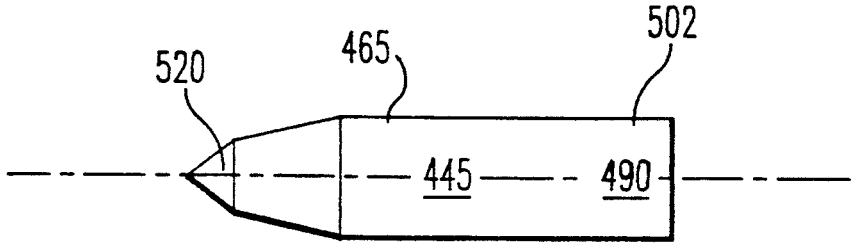

The variation in the shapes of the profile and the hardness HV30, before and after hammering, is shown in FIGS. 5 and 6.

EXAMPLE 3

Alloy of tungsten-nickel-iron with 98% of W

A mixture of powders with the following contents by weight is produced:
96.85% of pure tungsten
2.15% of pure nickel
1.00% of pure iron.

Figure 7:
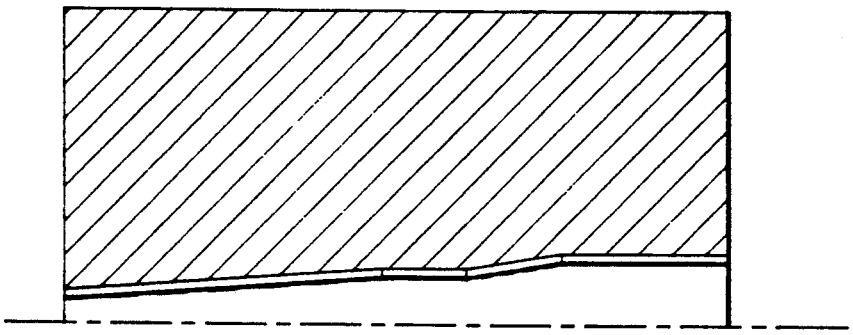
FIGS. 7 to 9 show the hammering profile and shaped blank profiles obtained by hammering of a rough shaped blank produced in Example 3.

Blanks are compressed in an isostatic chamber at 2000 bars in rubber molds, the shape of which is homothetic with that of the blank shown in FIG. 7. The blanks are sintered in a tunnel furnace in hydrogen at 1600° C. After a treatment under vacuum at 1100° C. testpieces having the following characteristics are obtained:
Rp0.2 =740 MPa approximately
Rm=960 MPa approximately
E % =17 approximately
density=18500 kg/m$^3$ approximately.

The hammering operation is then effected, using the machine referred to in Example 1. The profile of the hammers, which is adapted to that type of core, is shown in FIG. 7.

In this Example, the attempt was to achieve maximum hardness in the tip of the projectile, a high level of hardness combined with substantial ductility in its central portion and maximum ductility at the rear. The striking hammers were made of tungsten carbide and the blanks were preheated to about 450° C. the hammering operation was performed in two successive passes.

A heat treatment was then effected, in argon, at about 450° C.

Figure 8:
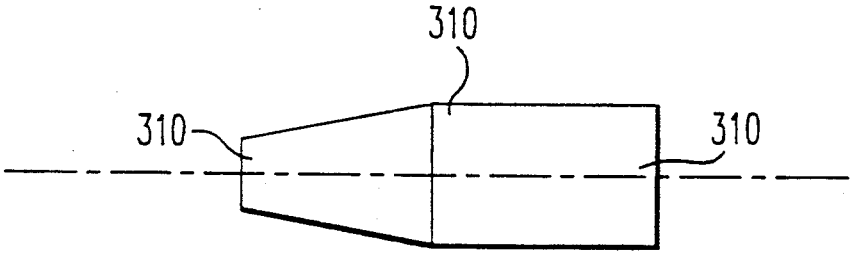
Figure 9:
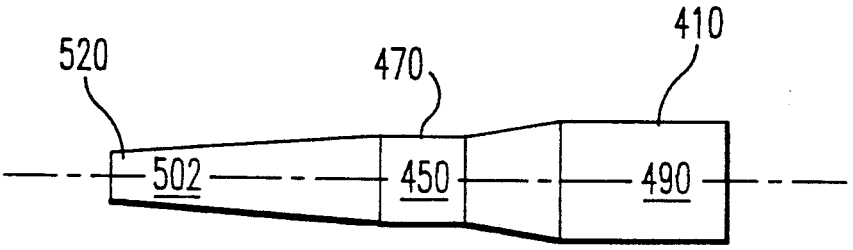

The variation in the shapes of the projectile and hardness of HV30, before and after hammering, is shown in FIGS. 8 and 9.

It can be seen that the hammering operation made it possible to increase the hardness values and to make the projectiles heterogeneous, in particular along the length of each projectile.

Having now fully described the invention, it will be apparent to one of ordinary skill in the art that many changes and modifications can be made thereto without departing from the spirit or scope of the invention as set forth herein.

What is claimed as new and be intended to be secured by Letter Patents in:

1. In a process for making penetrating projectiles useful in the manufacture of military ammunition, the steps consisting essentially of:

preparing a homogeneous alloy of tungsten, nickel and a metal selected from the group consisting of iron and copper by powder metallurgy;

compacting the alloy mass into a rough shaped blank having an axis of revolution;

sintering the rough shaped blank thereby producing a blank having a density of at least 17,000 kg/m$^3$; and without machining;

work-hardening in a rotary hammering operation, the sintered blank at a temperature ranging from ambient temperature to 500° C., according to the profile defined by the shape of the desired projectile, thereby directly producing, without final machining, the desired projectile having a degree of reduction varying from 5% to 60% in section, and a diameter essentially variable, in a direction parallel to the axis of said projectile, the travel of the hammers being controlled so that the dimensions of the penetrator with regard to diameter have a tolerance of ±0.05 mm.

2. In a process for making penetrators useful in the manufacture of military ammunition, the steps consisting essentially of:

preparing a homogeneous alloy of tungsten, nickel, and a metal selected from the group consisting of iron and copper by powder metallurgy;

compacting the alloy mass into a rough shaped blank having an axis of revolution;

sintering the rough shaped blank thereby producing a blank having a density of at least 17,000 kg/m$^3$; and without machining;

work-hardening in a rotary hammering operation, the sintered blank at a temperature ranging from ambient temperature to 500° C., according to the profile defined by the shape of the desired penetrator, thereby directly producing, without final machining, the desired penetrator having a degree of reduction varying from 5% to 60% in section, and a diameter essentially variable, in a direction parallel to the axis of said penetrator, the travel of the hammers being controlled so that the dimensions of the penetrator with regard to diameter have a tolerance of ±0.05 mm.

3. The process according to claim 2, wherein the alloy is a W-Ni-Fe or W-Ni-Cu alloy prepared from a mixture of appropriate metal powders and wherein a given alloy mass is compressed in a shaping mold and then sintered in hydrogen at a temperature between 1400° C. and 1600° C.

4. The process according to claim 3, wherein the alloy mass is compression molded into a cylindrical or parallelpiped shape.

5. The process according to claim 2, wherein work-hardening treatment which achieves a reduction in section is a rotary hammering operation.

6. The process according to claim 5, wherein the rotary hammering operation is produced by means of a hammering apparatus having a rotary-alternating action and fitted with a shaping tool arrangement comprising at least two hammers.

* * * * *